US008074310B1

(12) United States Patent
Robbins

(10) Patent No.: US 8,074,310 B1
(45) Date of Patent: Dec. 13, 2011

(54) SIDE-LYING SLEEP SUPPORT SYSTEM

(76) Inventor: Julie R. Robbins, Clearwater, FL (US)

( * ) Notice: Subject to any disclaimer, the term of this patent is extended or adjusted under 35 U.S.C. 154(b) by 0 days.

(21) Appl. No.: 12/661,213

(22) Filed: Mar. 12, 2010

Related U.S. Application Data

(60) Provisional application No. 61/210,002, filed on Mar. 13, 2009.

(51) Int. Cl.
*A47C 20/00* (2006.01)
*A47C 27/00* (2006.01)

(52) U.S. Cl. ..... 5/632; 5/631; 5/735; 5/930

(58) Field of Classification Search ..... 5/632, 631, 5/735, 930, 630, 731–734, 490
See application file for complete search history.

(56) References Cited

U.S. PATENT DOCUMENTS 2,470,398 A * 5/1949 Hayes ..... 5/710
3,444,567 A * 5/1969 Chasse et al. ..... 5/695
3,789,438 A * 2/1974 Hery ..... 5/695
3,843,980 A * 10/1974 Rodriguez ..... 5/733
4,840,362 A * 6/1989 Bremer et al. ..... 5/632
5,095,569 A * 3/1992 Glenn ..... 5/490
5,269,323 A * 12/1993 Krouskop ..... 5/632
5,664,271 A * 9/1997 Bellavance ..... 5/632
5,815,863 A * 10/1998 Dolisi ..... 5/632
5,978,990 A * 11/1999 Akey ..... 5/632
7,308,725 B2 * 12/2007 Cazzini et al. ..... 5/713

* cited by examiner

*Primary Examiner* — Robert G Santos

(57) ABSTRACT

A resilient base cushion has top and bottom surfaces, a peripheral side wall, upper and lower ends, an upper section, a lower section, and an intermediate section. A resilient head cushion has a middle component positioned across the top of the base cushion and side components laterally spaced from the upper section. A pair of similarly configured resilient leg cushions are partially positioned upon the intermediate and lower sections of the base cushion. Each cushion of a pair of similarly configured resilient abdominal cushions has a wedge-shaped configuration and is positioned upon the intermediate section of the base cushion above the leg cushions.

2 Claims, 4 Drawing Sheets

SIDE-LYING SLEEP SUPPORT SYSTEM

The present non-provisional patent application is based upon Provisional Application No. 61/210,002 filed Mar. 13, 2009, the subject matter of which is incorporated herein by reference.

BACKGROUND OF THE INVENTION

1. Field of the Invention

The present invention relates to a side-lying sleep support system and more particularly pertains to supporting a user, especially a pregnant woman, lying on her side for medical and comfort reasons, the supporting being done in a safe, sanitary, convenient and economical manner.

2. Description of the Prior Art

The use of sleep support systems of known designs and configurations is known in the prior art. More specifically, sleep support systems of known designs and configurations previously devised and utilized for the purpose of supporting pregnant women who lie on their side are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a side-lying sleep support system that allows supporting a user, especially a pregnant woman, lying on her side for medical and comfort reasons, the supporting being done in a safe, sanitary, convenient and economical manner.

In this respect, the side-lying sleep support system according to the present invention substantially departs from the conventional concepts and designs of the prior art, and in doing so provides an apparatus primarily developed for the purpose of supporting a user, especially a pregnant woman, lying on her side for medical and comfort reasons, the supporting being done in a safe, sanitary, convenient and economical manner.

Therefore, it can be appreciated that there exists a continuing need for a new and improved side-lying sleep support system which can be used for supporting a user, especially a pregnant woman, lying on her side for medical and comfort reasons, the supporting being done in a safe, sanitary, convenient and economical manner. In this regard, the present invention substantially fulfills this need.

SUMMARY OF THE INVENTION

In view of the foregoing disadvantages inherent in the known types of sleep support systems of known designs and configurations now present in the prior art, the present invention provides an improved side-lying sleep support system. As such, the general purpose of the present invention, which will be described subsequently in greater detail, is to provide a new and improved side-lying sleep support system and method which has all the advantages of the prior art and none of the disadvantages.

To attain this, the present invention essentially comprises a resilient base cushion having a horizontal top surface adapted to receive and support a user. The base cushion has a parallel bottom surface adapted to be positioned upon a recipient surface. The top and bottom surfaces are tapered and are spaced by a varying thickness to form a wedge. The base cushion has a vertical peripheral side wall between the top and bottom surfaces. The base cushion has an upper end and a lower end spaced by a length. The base cushion has an intermediate section with widely spaced arcuate side walls. The base cushion has an upper section with narrowly spaced side walls. The base cushion has a lower section with converging side walls. The intermediate section has a width between 40 and 60 percent of the length of the base cushion.

Next, a resilient head cushion is provided. The head cushion has a middle component and side components. The side components are positioned laterally spaced from the upper section of the body cushion. The side components have top surfaces in semi-cylindrical configurations. The middle component of the head cushion is positioned across the top of the base cushion and has a top surface in an undulating configuration. The middle and side components have thicknesses greater than the thickness of the upper end of the base cushion. Each cushion of a pair of similarly configured resilient leg cushions has a generally cylindrical configuration and a length. The majority of the length is positioned upon the intermediate and lower sections of the base cushion.

Each cushion of a pair of similarly configured resilient abdominal cushions has a wedge shaped configuration and is positioned upon the intermediate section of the base cushion.

Next, a plurality of cushion cases is provided. The cushion cases include a head cushion case, a leg cushion case, and a pair of abdominal cushion cases. The head cushion case has a linear central region located at the upper end of the base cushion. The head cushion case has parallel regions adjacent to the upper and intermediate sections of the base cushion and is located at right angles to the central region. The leg cushion case has laterally spaced regions positioned on the base cushion and a common region located below the base cushion. The abdominal cushion cases are similarly configured with each abdominal cushion being in a wedge-shaped configuration.

Lastly, zippers are provided. One of the zippers is on each of the cushion cases. The zippers include an upper zipper, a lower zipper and a pair of intermediate zippers. The upper zipper on the head cushion case is for adding the head cushions to, and removing the head cushions from, the head cushion case. The lower zipper on the leg cushion case is for adding the leg cushions to, and removing the leg cushions from, the leg cushion case. The intermediate zippers on the abdominal cushion cases are for adding the abdominal cushions to, and removing the abdominal cushions from, the abdominal cushion cases. The cushion cases are fabricated of a washable fabric to facilitate laundering.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved side-lying sleep support system which has all of the advantages of the prior art sleep support systems of known designs and configurations and none of the disadvantages.

It is another object of the present invention to provide a new and improved side-lying sleep support system which may be easily and efficiently manufactured and marketed.

It is further object of the present invention to provide a new and improved side-lying sleep support system which is of durable and reliable constructions.

An even further object of the present invention is to provide a new and improved side-lying sleep support system which is susceptible of a low cost of manufacture with regard to both materials and labor, and which accordingly is then susceptible of low prices of sale to the consuming public, thereby making such side-lying sleep support system economically available to the buying public.

Even still another object of the present invention is to provide a side-lying sleep support system for supporting a user, especially a pregnant woman, lying on her side for medical and comfort reasons, the supporting being done in a safe, sanitary, convenient and economical manner.

Lastly, it is an object of the present invention to provide a new and improved resilient base cushion having top and bottom surfaces, a peripheral side wall, upper and lower ends, an upper section, a lower section, and an intermediate section. A resilient head cushion has a middle component positioned across the top of the base cushion and side components laterally spaced from the upper section. A pair of similarly configured resilient leg cushions are partially positioned upon the intermediate and lower sections of the base cushion. Each cushion of a pair of similarly configured resilient abdominal cushions has a wedge-shaped configuration and is positioned upon the intermediate section of the base cushion above the leg cushions.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
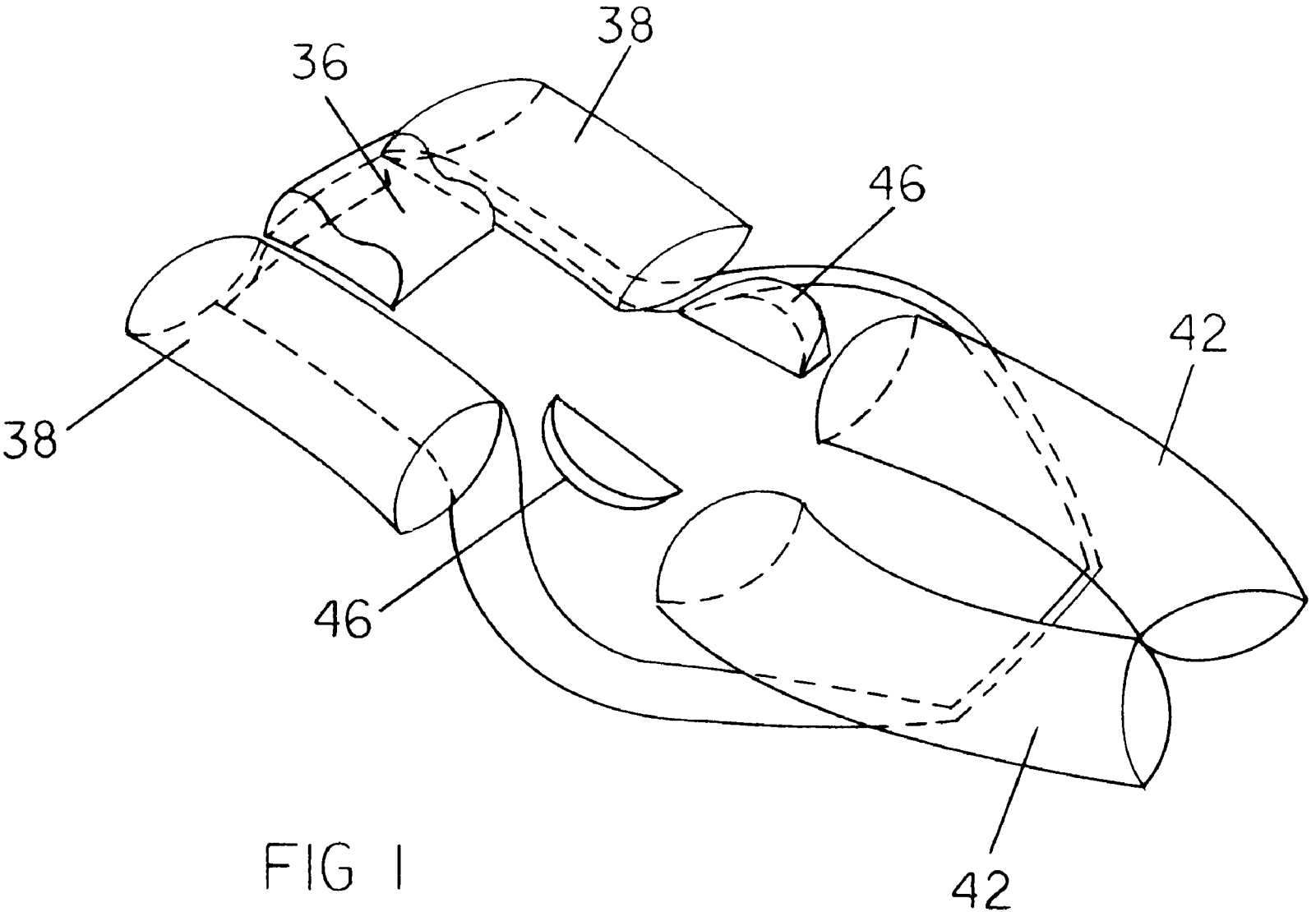
FIG. 1 is a perspective illustration of a side-lying sleep support system constructed in accordance with the principles of the present invention.
Figure 2:
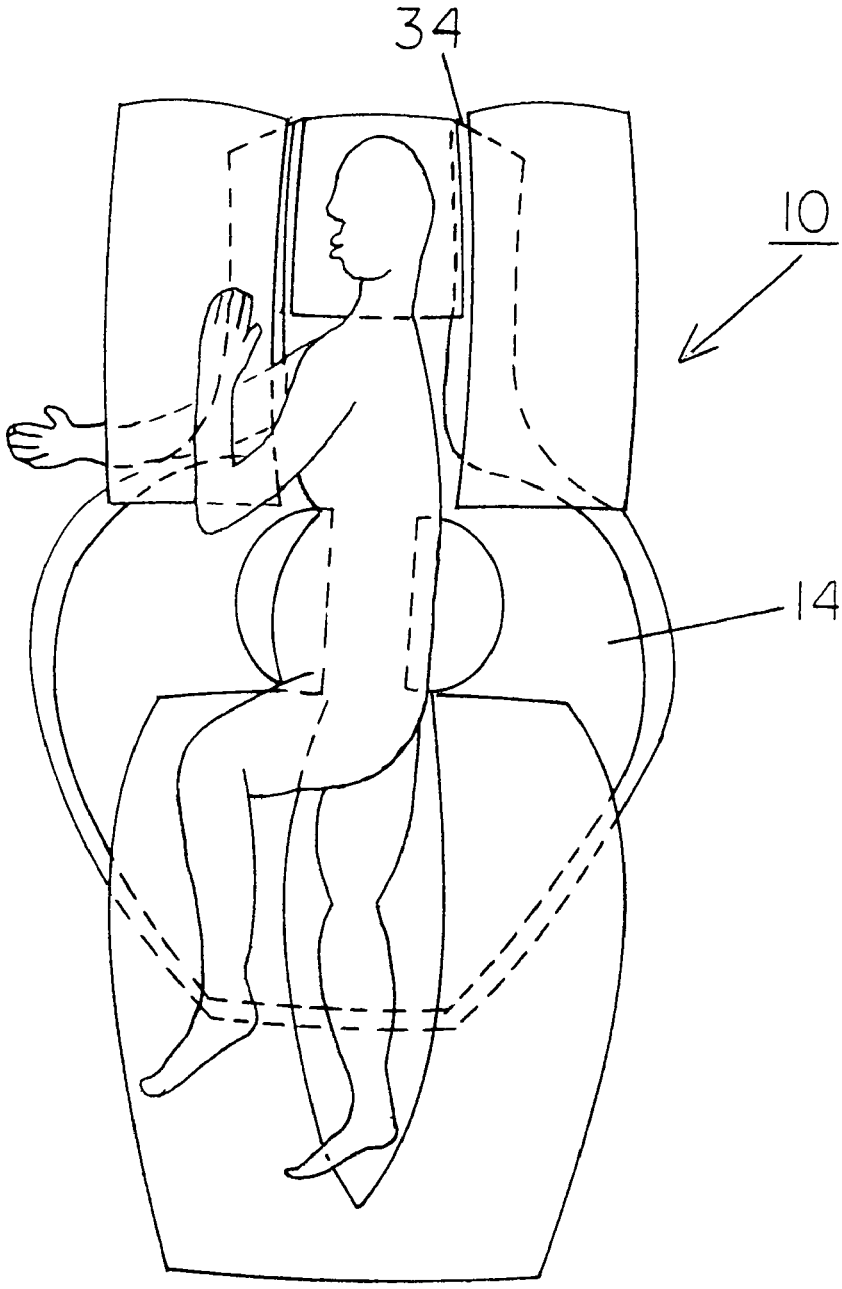
FIG. 2 is a plan view of the system of FIG. 1 but with a user in a sleeping position.
Figure 3:
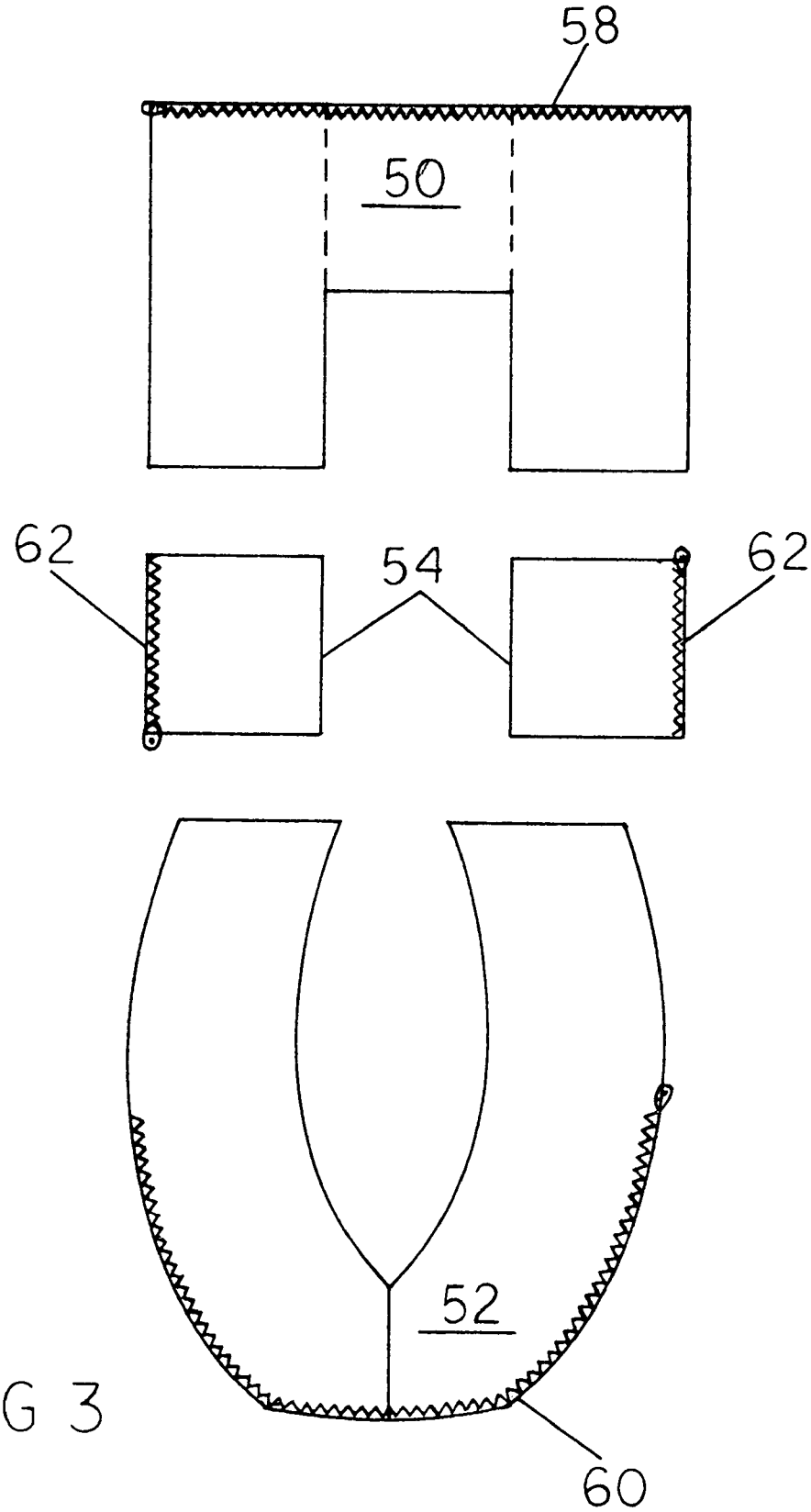
FIG. 3 is a plan view of the pillows illustrated in FIGS. 1 and 2.
Figure 4:
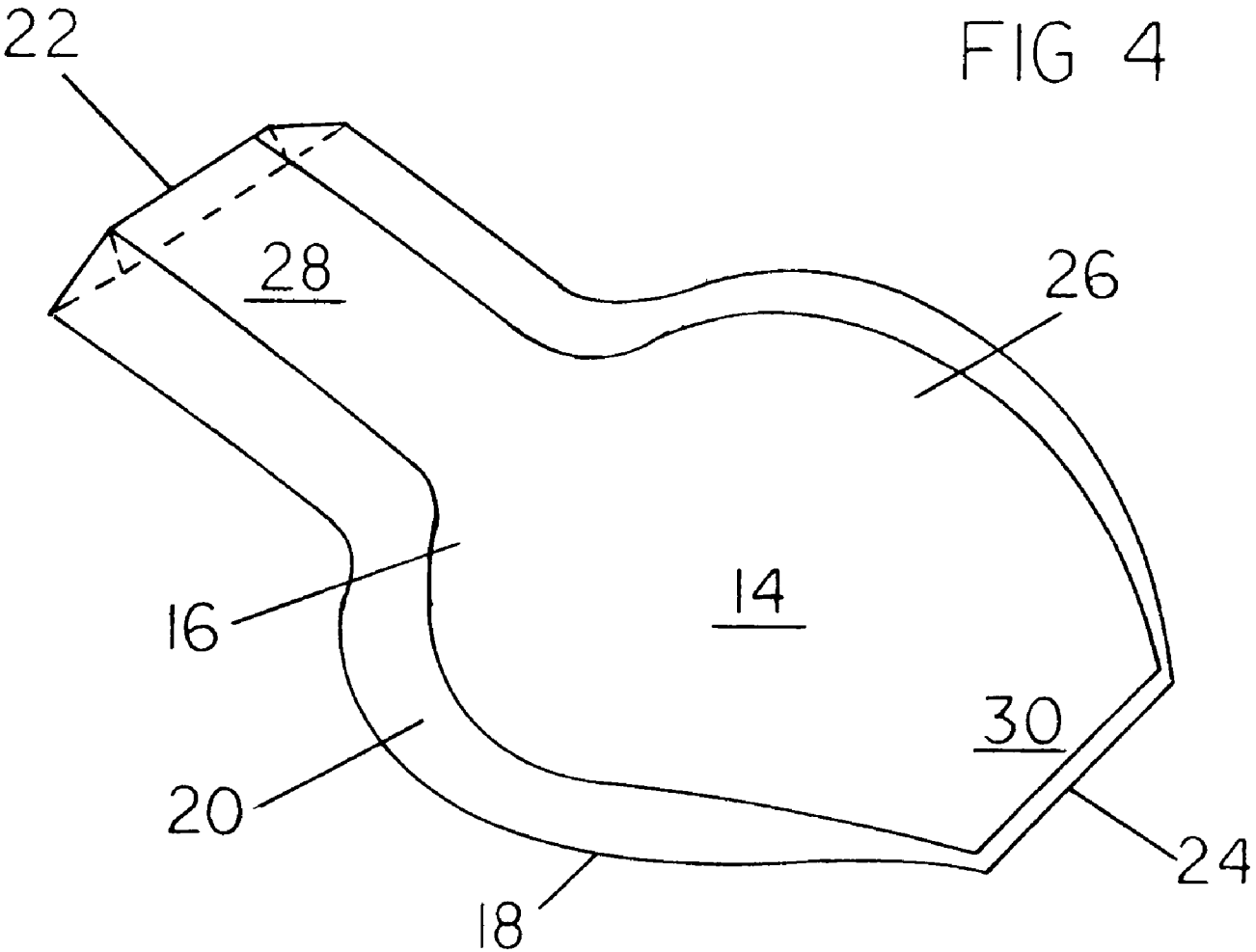
FIG. 4 is a perspective illustration of the base cushion of the prior Figures.

With reference now to the drawings, and in particular to FIG. 1 thereof, the preferred embodiment of the new and improved side-lying sleep support system embodying the principles and concepts of the present invention and generally designated by the reference numeral 10 will be described.

The present invention, the side-lying sleep support system 10 is comprised of a plurality of components. Such components in their broadest context include a resilient base cushion, resilient head cushion, a pair of resilient leg cushions, and a pair of similarly configured resilient abdominal cushions. Such components are individually configured and correlated with respect to each other so as to attain the desired objective. The side-lying sleep support system 10 is for supporting a user. Pregnant women and the like lie on their side for medical and comfort reasons. The supporting is done in a safe, sanitary, convenient and economical manner.

First provided is a resilient base cushion 14. The base cushion has a horizontal top surface 16 adapted to receive and support a user. The base cushion has a parallel bottom surface 18 adapted to be positioned upon a recipient surface. The top and bottom surfaces are tapered and are spaced by a varying thickness to form a wedge. The base cushion has a vertical peripheral side wall 20 between the top and bottom surfaces. The base cushion has an upper end 22 and a lower end 24 spaced by a length. The base cushion has an intermediate section 26 with widely spaced arcuate side walls. The base cushion has an upper section 28 with narrowly spaced side walls. The base cushion has a lower section 30 with converging side walls. The intermediate section has a width between 40 and 60 percent of the length of the base cushion.

Next, a resilient head cushion 34 is provided. The head cushion has a middle component 36 and side components 38. The side components are positioned laterally spaced from the upper section of the body cushion. The side components have top surfaces in semi-cylindrical configurations. The middle component of the head cushion is positioned across the top of the base cushion and has a top surface in an undulating configuration. The middle and side components have thicknesses greater than the thickness of the upper end of the base cushion. Each cushion of a pair of similarly configured resilient leg cushions 42 has a generally cylindrical configuration and a length. The majority of the length is positioned upon the intermediate and lower sections of the base cushion.

Each cushion of a pair of similarly configured resilient abdominal cushions 46 has a wedge shaped configuration and is positioned upon the intermediate section of the base cushion.

Next, a plurality of cushion cases 50, 52, 54 is provided. The cushion cases include a head cushion case 50, a leg cushion case 52, and a pair of abdominal cushion cases 54. The head cushion case has a linear central region located at the upper end of the base cushion. The head cushion case has parallel regions adjacent to the upper and intermediate sections of the base cushion and is located at right angles to the central region. The leg cushion case has laterally spaced regions positioned on the base cushion and a common region located below the base cushion. The abdominal cushion cases are similarly configured with each abdominal cushion being in a wedge-shaped configuration.

Lastly, zippers 58, 60, 62 are provided. One of the zippers is on each of the cushion cases. The zippers include an upper zipper 58, a lower zipper 60 and a pair of intermediate zippers 62. The upper zipper 58 on the head cushion case is for adding the head cushions to, and removing the head cushions from, the head cushion case. The lower zipper 60 on the leg cushion case is for adding the leg cushions to, and removing the leg cushions from, the leg cushion case. The intermediate zippers 62 on the abdominal cushion cases are for adding the abdominal cushions to, and removing the abdominal cushions from, the abdominal cushion cases. The cushion cases are fabricated of a washable fabric to facilitate laundering.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A side-lying sleep support system comprising:

a resilient base cushion having top and bottom surfaces and a peripheral side wall, the base cushion having upper and lower ends, the base cushion having an upper section and a lower section and an intermediate section;

a resilient head cushion having a middle component and side components, the side components being laterally spaced from the upper section of the base cushion, the middle component being positioned across the top of the base cushion;

a pair of similarly configured resilient leg cushions partially positioned upon the intermediate and lower sections of the base cushion;

a pair of similarly configured resilient abdominal cushions, each abdominal cushion having a wedge-shaped configuration and being positioned upon the intermediate section of the base cushion between and spaced from the head cushion and the leg cushions; and pillow cases for the head cushion, the leg cushions and the abdominal cushions and a zipper for each pillow case.

2. A side-lying sleep support system (10) for supporting a user, the system comprising, in combination:

a resilient base cushion (14) having a horizontal top surface (16) adapted to receive and support a user, the base cushion having a parallel bottom surface (18) adapted to be positioned upon a recipient surface, the top and bottom surfaces being tapered and spaced by a varying thickness to form a wedge, the base cushion having a vertical peripheral side wall (20) between the top and bottom surfaces, the base cushion having an upper end (22) and a lower end (24) spaced by a length, the base cushion having an intermediate section (26) with widely spaced arcuate side walls, the base cushion having an upper section (28) with narrowly spaced side walls, the base cushion having a lower section (30) with converging side walls, the intermediate section having a width between 40 and 60 percent of the length of the base cushion;

a resilient head cushion (34) having a middle component (36) and side components (38), the side components positioned laterally spaced from the upper section of the body cushion, the side components having top surfaces in semi-cylindrical configurations, the middle component of the head cushion being positioned across the top of the base cushion and having a top surface in an undulating configuration, the middle and side components having thicknesses greater than the thickness of the upper end of the base cushion;

a pair of similarly configured resilient leg cushions (42), each leg cushion having a generally cylindrical configuration and a length, the majority of the length being positioned upon the intermediate and lower sections of the base cushion;

a pair of similarly configured resilient abdominal cushions (46), each abdominal cushion having a wedge shaped configuration and being positioned upon the intermediate section of the base cushion;

a plurality of cushion cases including a head cushion case (50) and a leg cushion case (52) and a pair of abdominal cushion cases (54), the head cushion case having a linear central region located at the upper end of the base cushion, the head cushion case having parallel regions adjacent to the upper and intermediate sections of the base cushion and located at right angles to the central region, the leg cushion case having laterally spaced regions positioned on the base cushion and a common region located below the base cushion, the abdominal cushion cases being similarly configured with each abdominal cushion being in a wedge-shaped configuration; and a zipper on each of the cushion cases including an upper zipper (58), a lower zipper (60) and a pair of intermediate zippers (62), the upper zipper being in the head cushion case for adding the head cushions to and removing the head cushions from the head cushion case, the lower zipper being in the leg cushion case for adding the leg cushions to and removing the leg cushions from the leg cushion case, the intermediate zippers being in the abdominal cushion cases for adding the abdominal cushions to and removing the abdominal cushions from the abdominal cushion cases, the cushion cases being fabricated of a washable fabric to facilitate laundering.

* * * * *